US010752430B2

(12) United States Patent
Draghetti et al.

(10) Patent No.: US 10,752,430 B2
(45) Date of Patent: Aug. 25, 2020

(54) RESEALABLE CONTAINER INCLUDING INSERT

(71) Applicant: Philip Morris Products S.A., Neuchatel (CH)

(72) Inventors: Fiorenzo Draghetti, Medicina (IT); Marc Perrinjaquet, Chez-le-Bart (IT); Philippe Bourgoin, Echallens (CH)

(73) Assignee: Philip Morris Products S.A., Neuchatel (CH)

( * ) Notice: Subject to any disclaimer, the term of this patent is extended or adjusted under 35 U.S.C. 154(b) by 105 days.

(21) Appl. No.: 15/769,169

(22) PCT Filed: Sep. 21, 2016

(86) PCT No.: PCT/IB2016/055627
§ 371 (c)(1),
(2) Date: Apr. 18, 2018

(87) PCT Pub. No.: WO2017/072605
PCT Pub. Date: May 4, 2017

(65) Prior Publication Data

US 2018/0319576 A1 Nov. 8, 2018

(30) Foreign Application Priority Data

Oct. 26, 2015 (EP) ..... 15191535

(51) Int. Cl.
*B65D 85/10* (2006.01)
*B65D 5/42* (2006.01)

(52) U.S. Cl.
CPC ..... *B65D 85/1045* (2013.01); *B65D 5/4233* (2013.01); *B65D 85/1081* (2013.01); *B65D 2203/00* (2013.01)

(58) Field of Classification Search
CPC ..... B65D 85/1045; B65D 85/1081; B65D 5/4233; B65D 2203/00; A24F 15/08; A24F 15/18; A24F 15/12; A24F 15/02
(Continued)

(56) References Cited

U.S. PATENT DOCUMENTS 4,300,676 A * 11/1981 Focke ..... B65D 85/1045 206/264
5,160,024 A * 11/1992 Evers ..... B65D 5/4233 206/264
(Continued)

FOREIGN PATENT DOCUMENTS

DE 202014102485 U1 10/2015
RU 2443613 C2 2/2012
(Continued)

OTHER PUBLICATIONS

International Search Report and Written Opinion, issued by the European Patent Office for PCT/IB2016/055627, dated Nov. 23, 2015; 11 pgs.
(Continued)

*Primary Examiner* — Steven A. Reynolds
(74) *Attorney, Agent, or Firm* — Mueting Raasch Group

(57) ABSTRACT

Containers that include a housing that includes a box and a lid that is hingedly attached to the box. The container also includes an inner package disposed at least partially within the housing and at least partially defining an interior volume for housing consumer goods. The inner package includes a first layer and a second layer. The container also includes an insert positioned between the inner surface of the front wall of the box and the outer surface of the front wall of the inner package. The insert is positioned entirely below the sealing
(Continued)

region and is positioned so that the lowest point of the upper edge of the box is lower than the highest point of the upper edge of the insert.

15 Claims, 3 Drawing Sheets

(58) Field of Classification Search
USPC ..... 206/268, 264, 242
See application file for complete search history.

(56) References Cited

U.S. PATENT DOCUMENTS 6,478,149 B1 * 11/2002 Parker ..... B65D 5/18 206/273
6,505,735 B1 * 1/2003 Parker ..... B65D 75/5838 206/268
8,091,703 B2 * 1/2012 Marchetti ..... B65D 5/606 206/268
8,511,462 B2 * 8/2013 Mezzini ..... B65D 5/48014 206/38
9,499,331 B2 * 11/2016 Seyfferth De Oliveira ..... B65D 85/1045
2010/0252462 A1 * 10/2010 Marchetti ..... B65D 5/606 206/268
2010/0276311 A1 11/2010 Societa'Per Azioni
2011/0114518 A1 * 5/2011 Hein ..... B65B 19/20 206/268
2011/0147443 A1 * 6/2011 Igo ..... B65D 75/5838 229/117.31
2012/0006823 A1 * 1/2012 Bertuzzi ..... B65D 75/5838 220/270

FOREIGN PATENT DOCUMENTS

WO WO 2013/120913 A1 8/2013
WO WO 2015/011621 A1 1/2015
WO WO 2015/045070 A1 2/2015

OTHER PUBLICATIONS

International Preliminary Report on Patentability, issued by the European Patent Office for PCT/IB2016/055627, dated Jan. 4, 2018; 14 pgs.
Extend European Search Report, issued by the European Patent Office for EP 15191535.2-1708; 7 pgs.
Russian Decision to Grant and Search Report for RU Application No. 2018115301, issued by the Russian Patent Office dated Sep. 20, 2019; 13 pgs. Including English translation.

* cited by examiner

RESEALABLE CONTAINER INCLUDING INSERT

This application is the § 371 U.S. National Stage of International Application No. PCT/IB2016/055627, filed 21 Sep. 2016, which claims the benefit of European Application No. 15191535.2, filed 26 Oct. 2015, the disclosures of which are incorporated by reference herein in their entireties.

Resealable container that includes an accessible insert. The container finds particular application as a container for elongate smoking articles such as cigarettes.

It is common in the industry to use inserts as a means of communication.

WO 2015/011621 shows a resealable pack that includes an insert, but the insert has a shape (at its top) that mirrors an offset seal on the lid. The mirrored portion of the insert affords a tab with which to gain access to the insert. Such a configuration would require the container and methods of making the container to be drastically modified.

WO 2015/045070 provides an inner liner with a fin seal across the front wall that creates a pocket on the front wall of the container to hold an insert. The pocket limits the size of the insert significantly.

With the above discussed containers as well a typically utilized resealable containers and more specifically automatically resealable containers, use of an insert is not possible because there is no space available to access additional components, like an insert.

One object of the invention is to provide a container that both affords automatic opening and resealing of an inside sealed package upon opening the outer lid and access to an insert.

In one aspect of the present invention, a container is described. The container comprises a housing that comprises a box and a lid that is hingedly attached to the box. The lid comprises a front wall that has an inner surface, an outer surface and a bottom edge. The container also comprises an inner package disposed at least partially within the housing and at least partially defining an interior volume for housing consumer goods. The inner package comprises a first layer and a second layer. The first layer comprises a flap which is attached to the inner surface of the lid and is configured to be releasably attached to a sealing region of the second layer to open and close the inner package by opening and closing the lid of the container. The container also comprises an insert positioned between the inner surface of the front wall of the box and the outer surface of the front wall of the inner package. The insert is positioned entirely below the sealing region and is positioned so that the lowest point of the upper edge of the box is lower than the highest point of the upper edge of the insert.

In other aspects of the present invention the insert includes an access region that allows it to be removed from the container. The housing, the sealing region, or both can be configured to both afford resealabilty of the container and access to the insert. In some embodiments, the lid of the box can be longer than previously utilized lids. In some embodiments, a longer lid can be accomplished by extending the front wall of the box, by changing the angle of the opening line of the box, or both. In some embodiments, the label can be modified, to make it shorter. In some embodiments, the access region of the insert can include a tab that affords egress and ingress of the insert out of and into the container.

Various aspects of the present invention may provide one or more advantages relative to currently—available or previously—described containers. For example, the present containers combine the feature of being automatically resealable with the use of inserts, which up until the present invention were unable to be combined. Furthermore, the present containers afford the combination of these two features but do not sacrifice proper functionality of the automatic closure of the inner feature.

The present invention is applicable to any suitable container for consumer goods such as for example elongate smoking articles. It is known to package consumer goods such as, for example, elongate smoking articles in containers formed from folded laminar blanks. For example, elongate smoking articles, such as cigarettes and cigars, are commonly sold in hinge lid packs having a box for housing the smoking articles and a lid connected to the box about a hinge line extending across the back wall of the container.

The container may take any suitable form for housing consumer goods. For example, as already mentioned, the container may comprise a housing that can be described as a hinge-lid container having one or more hinged lids connected to a box housing the consumer goods. In one or more embodiments, the container may be a slide and shell container having an inner slide for housing the consumer goods mounted within an outer shell. Where the container is a slide and shell container, the outer shell or the inner slide may include one or more hinge lids. The container may be formed from any suitable materials including, but not limited to, cardboard, paperboard, plastic, metal, other materials, or combinations thereof. The cardboard may have a weight of between about 100 grams per square meter and about 350 grams per square meter.

Containers described herein will generally have the same or a similar shape as the housing. As such housings according to the invention may be in the shape of a rectangular parallelepiped, with right-angled longitudinal and right-angled transverse edges. Alternatively, the housing may comprise one or more rounded longitudinal edges, rounded transverse edges, bevelled longitudinal edges, or bevelled transverse edges, other types of edges, or combinations thereof. For example, the housing according to the invention may comprise, without limitation, one or more of the following features:

- one or two longitudinal rounded or bevelled edges on at least one of the front wall and the back wall;
- one or two transverse rounded or bevelled edges on at least one of the front wall and the back wall;
- one longitudinal rounded edge and one longitudinal bevelled edge on the front wall, or one transverse rounded edge and one transverse bevelled edge on the back wall;
- one longitudinal rounded edge and one longitudinal bevelled edge on the front wall, and one transverse rounded edge and one transverse bevelled edge on the back wall;
- one or two transverse rounded or bevelled edges on the front wall and one or two longitudinal rounded or bevelled edges on the front wall; and
- two longitudinal rounded or bevelled edges on a first side wall or two transverse rounded or bevelled edges on the second side wall.

Where the housing comprises one or more rounded edges, preferably the blanks forming the housing comprise three, four, five, six, or seven scoring lines or creasing lines to form each rounded edge in the assembled container. The scoring lines or creasing lines may be either on the inside of the housing or on the outside of the housing. Preferably, the scoring lines or creasing lines are spaced from each other by between about 0.3 millimetres (mm) and 4 mm.

Preferably, the spacing of the creasing lines or scoring lines is a function of the thickness of the laminar blank. Preferably, the spacing between the creasing lines or scoring lines is between about 0.5 and about 4 times larger than the thickness of the laminar blank.

Where the housing comprises one or more bevelled edges, preferably the bevelled edge has a width of between about 1 mm and about 10 mm, preferably between about 2 mm and about 6 mm. In one or more embodiments, the housing may comprise a double bevel formed by three parallel creasing or scoring lines that are spaced such that two distinct bevels are formed on the edge of the container. Where the housing comprises a bevelled edge, the bevel may be formed by two parallel creasing lines or scoring lines in the laminar blank from which the container is formed. The creasing lines or scoring lines may be arranged symmetrically to the edge between a first wall and a second wall. Alternatively, the creasing lines or scoring lines may be arranged asymmetrically to the edge between the first wall and the second wall, such that the bevel reaches further into the first wall of the container than into the second wall of the housing.

Alternatively, the housing may have a non-rectangular transverse cross section, for example, polygonal such as triangular or hexagonal, or oval, semi-oval, circular or semi-circular.

Containers according to the invention find particular application as packs for elongate smoking articles such as, for example, cigarettes, cigars or cigarillos. In other embodiments, the consumer goods may be aerosol-generating articles such as articles that heat but not burn tobacco. It will be appreciated that through appropriate choices of the dimensions thereof, containers according to the invention may be designed for different numbers of conventional size, king size, super-king size, slim or super-slim cigarettes. Through an appropriate choice of the dimensions thereof, containers or housings according to the invention may be designed to hold different total numbers of smoking articles, or different arrangements of smoking articles. For example, through an appropriate choice of the dimensions thereof, containers or housings according to the invention may be designed to hold a total of between ten and thirty smoking articles.

As well as housing a bundle of smoking articles, the container may further comprise other consumer goods, for example, matches, lighters, extinguishing means, breath—fresheners, or electronics. The other consumer goods may be attached to the outside of the container, contained within the container along with the smoking articles, in a separate compartment of the container, or any combination thereof.

Disclosed containers comprise a housing. The housing has an inner surface and an outer surface. The housing also has a rear wall, a front wall and two side walls. The housing comprises a lid and a box.

The lid of the housing is hingedly attached to the box and is adapted to be manipulated between an open position and a closed position. In the open position, the consumer can access the consumer goods disposed within the housing. The lid is hingedly attached to the box along a hinge line that extends across the rear wall or the upper edge of the rear wall of the housing. A hinge line may be, for example, a fold line or a score line in the panel forming the back wall of the housing. The lid and box are further defined by an opening line. The opening line refers to the delineation between the lid and the box which begins at one end of the hinge line traverses the right side of the housing, the front of the housing then the left side of the housing, or vice versa, and ends at the other end of the hinge line.

Preferably, the box comprises a box front wall, a box left side wall, a box right side wall, a box back wall, and a box bottom wall. The box has an inner surface and an outer surface. The front wall of the box has an upper edge, which when closed meets the bottom edge of the lid.

Preferably the lid comprises a lid front wall, a lid left side wall, a lid right side wall, a lid back wall, and a lid top wall. The lid has an inner surface and an outer surface. The front wall of the lid also has a bottom edge.

The side walls of the lid are defined by the opening line. The opening line on the side walls can be defined by an angle made between the back wall of the box and the opening line, referred to as the opening line angle. In some embodiments, the lid can be made longer by making the opening line angle smaller than that of previously utilized, typical consumer goods containers. In embodiments where the lid is being made longer by decreasing the opening line angle, the angle can be less than about 60 degrees, less than about 55 degrees, or less than about 50 degrees, for example. In such embodiments, the opening line angle can be not less than 30 degrees, not less than 35 degrees, or not less than 40 degrees for example. In such embodiments, the front wall of the lid is longer because of the smaller opening line angle. Such embodiments allow the sealing region of the inner package to remain unchanged while at the same time, the insert can still be accessed, the insert does not interfere with the resealable label, the insert is covered by the bottom edge of the lid before being removed, or any combination thereof.

A longer front wall of the lid can also be accomplished by modifying the opening line in other ways, for example it can be made curved, concave, stepped or comprising other suitable shapes.

A longer front wall of the lid can also be accomplished even if the opening line angle remains typical, for example, at about 60 degrees or greater. This can be accomplished by making the front wall of the lid longer than normal. In some embodiments, the front wall of the lid can have a height (from the top of the lid to the lower edge of the lid) that is less than 60 mm, or preferably less than 45 mm. In some embodiments, the front wall of the lid can have a height that is greater than 25 mm, or preferably greater than 28 mm. The height of the front wall of the lid can also be described with respect to the front wall of the box. In some embodiments, the ratio of the height of the front wall of the lid to the height of the front wall of the box is not less than 35:65.

The container also comprises an inner package. The inner package is disposed within the housing of the container. The inner package can be configured to house consumer goods. Illustrative consumer goods can include smoking articles such as elongate smoking articles. Specific illustrative elongate smoking articles can include for example cigarettes, cigars, cigarillos, consumer goods such as aerosol-generating articles that heat but not burn tobacco, or combinations thereof.

The inner package can be made of any suitable materials, for example, polymeric materials, metal foils, other materials, or combinations thereof. The inner package preferably comprises polymeric materials such as polyethylene films, polyolefin films, poly lactic acid (PLA) films, or some combination thereof. Preferably, the inner package can comprise a first layer and a second layer that are attached, at least at their peripheries to form a package with an interior volume.

The inner package comprises an access opening that affords access to the consumer goods housed inside when the inner package is opened. The flap of the inner package covers the access opening when the container and the flap are in a closed position. The access opening is at least partially uncovered when the container and the flap are in the open position. The access opening can be cut during manufacturing, for example. Preferably, the flap forms an S—shape, a curve with at least two turning points, when the flap is open.

The inner package also comprises a flap. Preferably, the first layer of a multilayer inner package comprises a flap. The flap can be attached to the inner surface of the lid, via adhesive, or otherwise. In some embodiments, the flap can be attached to the inner surface of the lid with a label comprising one or more sealing areas that preferably include adhesive.

In some embodiments, the inner package, or preferably the flap comprises or can be coupled to a resealable label. The resealable label can be configured to attach the flap to the inner surface of the lid as well as reseal the inner package. In such an embodiment, when opening the lid and the inner package, a portion of the second layer attached to the flap, the sealing region, are separated from each other along first and second cut lines respectively to reveal the access opening. The resealable label can be attached to the lid using any suitable techniques, for example, mechanical attachment, adhesive, thermal, or ultrasonic bonding. Preferably, the resealable label can be attached to the lid using an adhesive, more preferably a permanent adhesive. The resealable label can be configured to be re-attached to the second layer when the flap and the lid of the container are in the closed position.

The resealable label allows for repeated opening and closing of the inner package to access the consumer goods individually. The resealable label preferably provides sufficient adhesion for the flap to be re-attached at least as many times as there are consumer goods within the inner package. The resealable label preferably enables a consumer to open and reseal the inner package until the package is empty.

The resealable label has an inner surface and an outer surface. The outer surface of the resealable label can be configured to permanently attach the label and in some embodiments the flap of the inner package to the inner surface of the front wall of the lid.

The inner surface of the resealable label can comprise at least a sealing area and a non-sealing area. The sealing area can be such that movement of the lid between open and closed positions simultaneously moves the flap and the access opening of the inner package between opened and closed positions. In the closed position, the flap and label cover the access opening of the inner package and is resealably attached to the inner package by the resealable adhesive. In the open position, the flap and label are at least partially detached from the inner package and the access opening of the inner package is at least partially uncovered or opened. The sealing area of the label can utilize an adhesive for example, preferably a pressure sensitive adhesive. The non-sealing area of the inner surface of the label is preferably positioned at the lower end of the label, which will be towards the bottom edge of the lid. The non-sealing area can allow for the sealing area to be more easily opened.

In some embodiments, the sealing area of the resealable label can have a height that is shorter than typically or previously utilized. In some embodiments, the height of the sealing area of the resealable label (along a direction from the bottom edge of the lid to the top of the lid or container) is less than about 20 mm, or preferably less than about 18 mm. In some embodiments, the height of the sealing area of the resealable label is greater than about 10 mm, or preferably greater than about 12 mm. In such embodiments, the lower edge of the sealing area of the resealable label can be shifted upward (away from the bottom edge of the lid) to make the sealing area shorter. This affords more room under the lid for the insert. In such embodiments, the lid can extend at least 2 mm beyond the sealing area of the resealable label.

Combinations of smaller opening line angles, longer front walls, and shorter sealing areas of resealable labels, as well as any other methods of making the space between the bottom edge of the front wall of the lid and the sealing area of the label longer could also be utilized herein.

The container also comprises an insert. The insert can be utilized for communication. The insert can comprise or be made of any suitable materials. For example, the insert can comprise cardboard, paperboard, paper, plastic, metal, or combinations thereof. The insert can be printed thereon for example using any known printing techniques. The insert can be folded in order to increase the available communication space. The insert can be folded longitudinally or transversally or both longitudinally and transversally. Preferably, at least one dimension of the insert (whether in total or once folded), for example, the height of the insert, can be less than the height of the front wall of the box. Preferably, the length of the insert is between the length of the longest longitudinal length of the front wall and the length of the front wall in the area of the access region. Such configurations afford the use of the maximum length of the insert. Preferably, the other dimension of the insert (whether in total or once folded), for example the width of the insert, can be less than the width of the front of the box. Because of the ability to fold the insert, once, twice, or more often the overall surface area of the insert can be larger than the front wall of the box.

The insert is positioned between the inner surface of the front wall of the box and the outer surface of the front wall of the inner package. The insert has an upper edge. The upper edge of the insert is accessible via an access region of the insert. The access region of the insert is the region or portion of the insert that is not covered by the front wall of the box when the insert is disposed in the container. The access region is typically a top portion of the insert. In some embodiment, the access region can be the portion of the insert from the upper edge down from about 2 mm to about 10 mm, for example. In some embodiments, the access region of the insert is only accessible once the container has been opened, or more specifically once the lid has been opened.

In some embodiments, the access region of the insert is accessible even if the container has not been opened. One such embodiment includes an insert that comprises a tab. The tab can be located at the upper edge of the insert and can extend away or above the box when the insert is positioned between the box and the inner package. In some embodiments, the tab can be folded 90 degrees to the front wall of the box so it can be easily grasped and the insert removed. The tab can be made of the same material as the insert or a different material. The tab can be an extension of the remaining portion of the insert. The tab can be a coextensive portion of the insert that is folded towards the insert and facing the front wall of the box.

The container can also comprise an optional inner frame disposed within the box. The inner frame can be disposed inside the front wall of the box. Advantageously, an inner frame with a large surface area provided adjacent the front wall of the box increases the structural strength of the container. This is particularly advantageous for subsequent use when the container is no longer full. A container can also optionally include an inner liner. The inner liner can wrap the consumer goods. The inner liner and the consumer goods can collectively be referred to as an inner package. A carton that includes a lid and at least one sidewall can contain multiple containers as described herein.

Containers of the present invention function to both afford a resealable package and access to an insert. In embodiments where the access region of the insert is covered by the lid when the container is closed, opening the lid of the container will allow for egress and ingress of the insert.

A carton that includes a lid and at least one sidewall can contain multiple containers as described herein. A carton comprises, houses or holds at least one container. A carton can contain only disclosed containers or can contain disclosed containers as well as other items. In some preferred embodiments, a carton comprises, houses or holds from five to ten disclosed containers.

The term "inner surface" is used throughout the specification to refer to the surface of a component of the assembled container that is facing towards the interior of the container, for example towards the consumer goods, when the container is in the closed position. For example, the outer film comprises an inner surface that is facing the housing of the container.

The term "outer surface" is used throughout the specification to refer to the surface of a component of the container that is facing towards the exterior of the container. For example, the outer film comprises an outer surface that is facing away from the housing of the container. It should be noted that the inside or outside surface is not necessarily equivalent to a certain side of a blank used in assembly of the container. Depending on how the blank is folded around the consumer goods, areas that are on the same side of the container can either face towards the inside or the towards the outside of the container.

The terms "front," "back," "upper," "lower," "top," "bottom," and "side" refer to the relative positions of portions of containers according to the invention and components thereof when the container is in an upright position with the lid of the housing in the closed position and the hinge line at the rear of the container. When describing containers according to the present invention, these terms are used irrespective of the orientation of the container being described. The rear or back wall of the container includes the hinge line.

Referring now to the drawings, in which some aspects of the present invention are illustrated.

Figure 1:
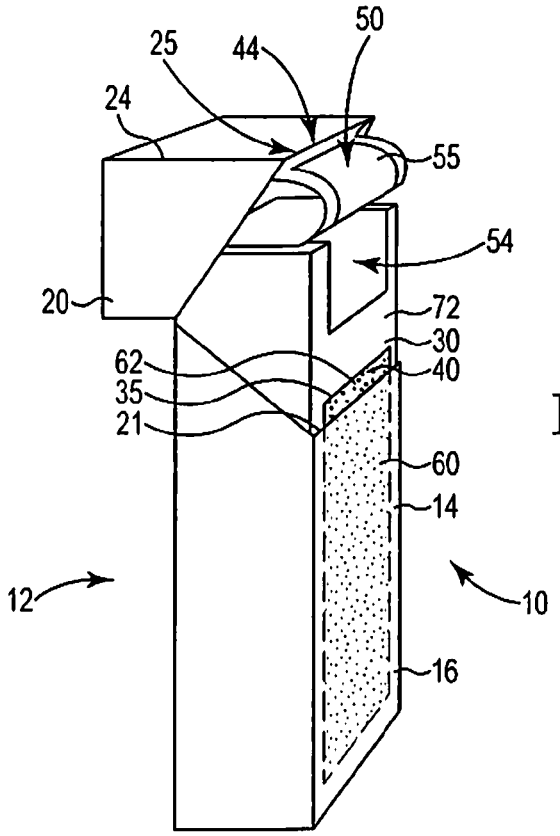
FIG. 1 is a schematic perspective view of a container in an open position, where the container comprises an access region comprising a line of weakness and an insert.

Referring to FIG. 1, a schematic perspective view of an embodiment of a container 10 for consumer goods is depicted. The container includes a housing 12 that includes a box 14 and a lid 20 hingedly attached to the box via a hinge line (not shown). The box has a front wall 16 and a rear wall 18. The front wall of the box has an upper edge 21. The box also has an inner surface 17 and an outer surface 19. The hinge line extends across the back wall 18 of the box 14 of the container 10, and acts to allow the lid 20 to be moved from a closed position (FIG. 3) to an open position as shown in FIG. 1. The lid 20 has a front wall 24 that has an inner surface 22 and an outer surface 26 (FIG. 2).

An inner package 30 is disposed within the housing 12. The inner package 30 at least partially defines an interior volume for housing consumer goods. The inner package 30 is made from a barrier material or materials to hermetically seal the consumer goods before the container is opened for the first time. The barrier material may be a metal foil or a plastic and metal laminate. The inner package 30 includes a front wall 32 and a back wall 34 (seen in FIG. 2). The inner package 30 includes an outer surface 33. The inner package also includes a first layer 40 and a second layer 50 attached to an inner surface of the first layer.

The inner package 30 includes an access opening 54 through which the consumer goods (not shown) can be removed. The access opening 54 is covered by the flap 44 when the flap is in the closed position (FIG. 3). Further, the access opening 54 is at least partially uncovered when the flap 44 is in the open position. The flap can include or be coupled with a label the label includes a sealing area and a non-sealing area. The flap and the label are not distinguishable in the figures and element 44 can be considered as referring to both of them. The flap 44 can be attached to the first layer 40 along a hinge line 49 (FIG. 2). The flap 44 is also attached to an inner surface 22 (FIG. 2) of the front wall 24 of the lid 20 such that upon opening the lid the flap and a portion 55 of the second layer 50 attached to the flap are separated from the inner package 30 along first and second lines of weakness (not shown herein) to reveal the access opening 54. The flap 44 is adapted to overlap the access opening 54 into a sealing region 72 such that the flap attaches to the second layer 50 within the sealing region 72 when the flap is in the closed position.

Figure 2:
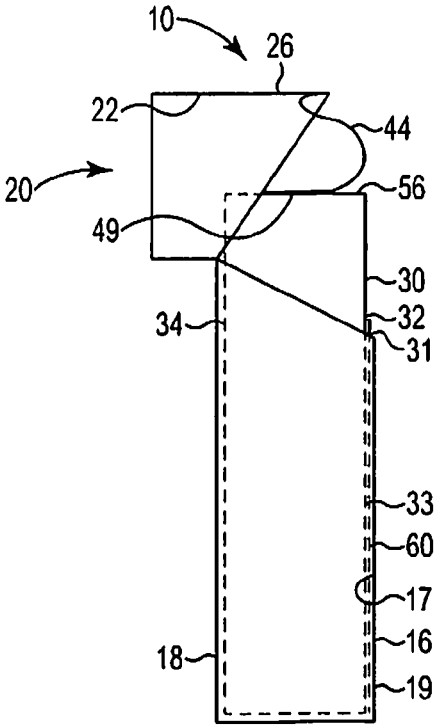
FIG. 2 is a schematic perspective view of the side of the container of FIG. 1 in an open position.
Figure 3:
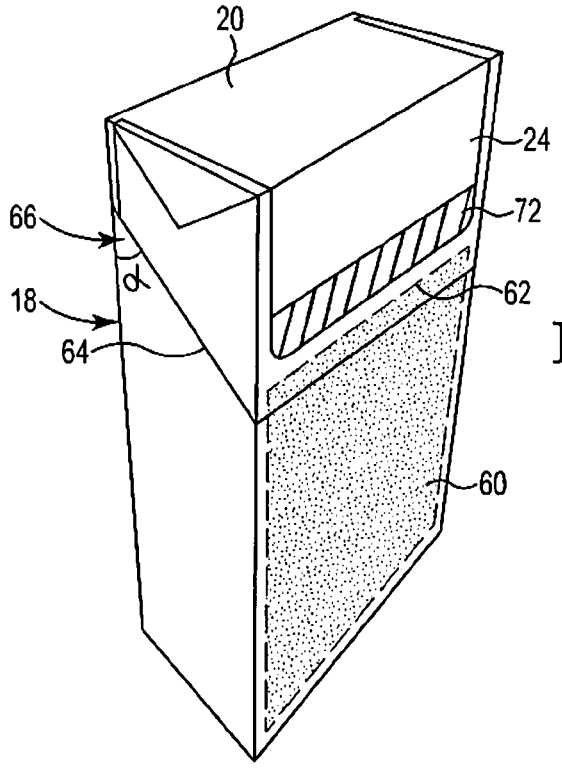
FIG. 3 is a schematic perspective view of the front of the container of FIG. 1 in a closed position.

Referring to FIG. 2, a schematic cross-section view of the container 10 of FIG. 1 is depicted with the lid 20 and the flap 44 in the open position. The inner package 30 is shown disposed within the box 14 of housing 12. The flap 44 is attached to the lid 20. In the open position, the flap 44 forms an S-shape. The geometry of the container 10 is such that the flap 44 is automatically resealed to the inner package 30 when the flap (and the lid 20) is returned to the closed position.

All of the figures also show an insert 60. The insert 60 is positioned between the inner surface 17 of the front wall 18 of the box and the outer surface 32 of the front wall 31 of the inner package 30. The insert has an upper edge 35 that is accessible via an access region 62. The insert can be made of any useful material, can have any useful dimensions, and can optionally be folded either transversally or longitudinally or both transversally and longitudinally. The insert is positioned entirely below the sealing region 72 of the second layer 50. If the insert were positioned above the sealing region 72, the sealing area of the label that functions to close the inner package would be adhered to the insert and the inner package would no longer be resealable. Furthermore, the lowest point of the upper edge 21 of the box 14 (even if it is not linear) is lower than the highest point of the upper edge 35 of the insert 60 so that the insert 60 can be accessed.

Referring to FIG. 3, a schematic perspective view of an embodiment of a container that includes a lid 20 with a front wall 24 that is longer than a typical or previously utilized lid is illustrated. The specific way in which this lid is formed in FIG. 3 is to modify the angle of the opening line 64. As seen in FIG. 3, the angle of the opening line 66, given as a in FIG.3 is measured from the back wall 18 of the box 14 is less than about 60 degrees, less than about 55 degrees, or less than about 50 degrees, for example. In such embodiments, the angle $\alpha$ can be greater than 30 degrees, greater than 35 degrees, or greater than 40 degrees for example. Decreasing the angle between the back wall 18 of the box and the opening line 64 serves to increase the length of the front wall 24 of the lid 20. This allows more room below the sealing region 72 for the access region 62 of the insert 60 to exist when the lid is closed. The insert 60 in such an embodiment would not be accessible unless the lid is opened.

Figure 4:
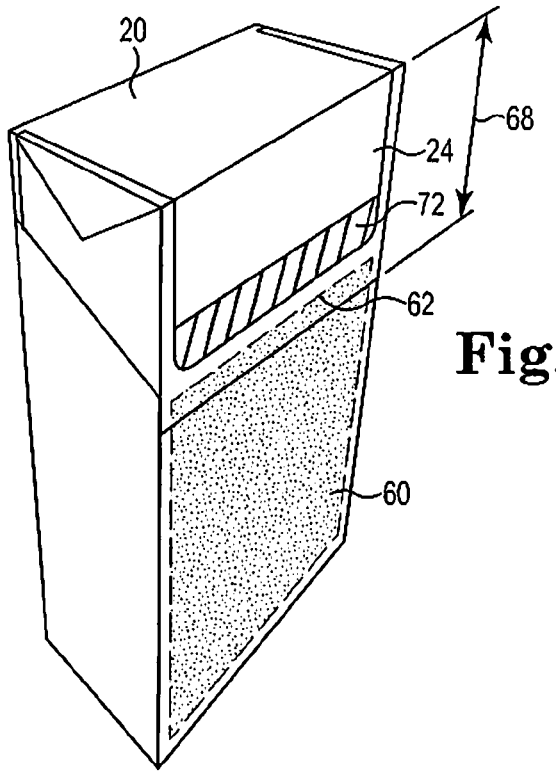
FIG. 4 is a schematic perspective view of a container in an open position, where the container comprises an access region and an insert.

Referring to FIG. 4, a schematic perspective view of another embodiment of a container that includes a lid 20 with a front wall 24 that is longer than for example a standard king size box for 20 smoking articles. This lid is made longer by maintaining a typical angle between the back wall and the opening line but extending the front wall of the lid downwards toward the bottom of the box 14. The height of the front wall 24 of the lid 20 is shown in FIG. 4 as reference numeral 68. The height 68 of the front wall 24 in such embodiment is less than 60 mm, or preferably less than 45 mm. In some embodiments, the front wall of the lid can have a height 68 that is greater than 25 mm, or preferably greater than 28 mm. The height of the front wall of the lid can also be described with respect to the front wall of the box. In some embodiments, the ratio of the height of the front wall of the lid to the height of the front wall of the box is not less than 35:65. This allows more room below the sealing region 72 for the access region 62 of the insert to exist. The insert 60 in such an embodiment would not be accessible unless the lid is opened.

Figure 5:
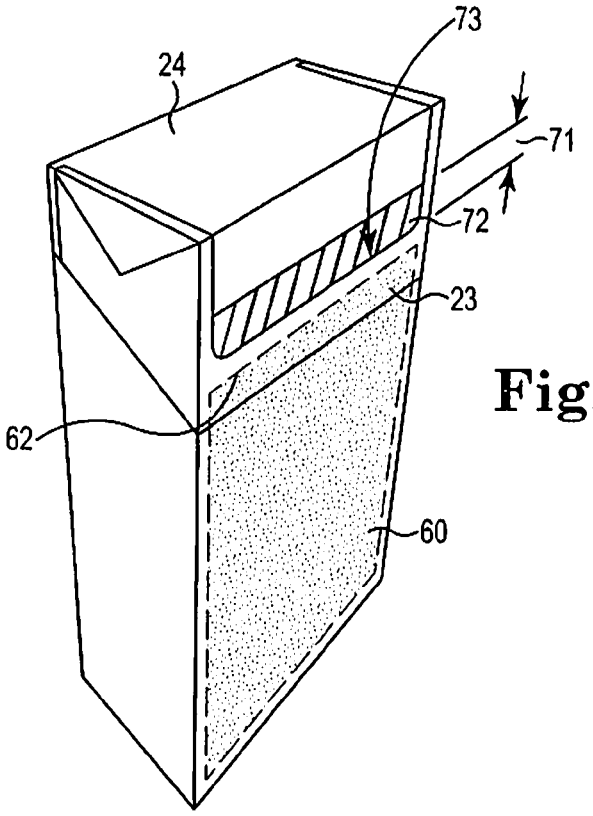
FIG. 5 is a schematic perspective view of a container in an open position, where the container comprises an access region comprising a line of weakness and an insert.

Referring to FIG. 5, a schematic perspective view of another embodiment of a container that includes a sealing region that is shorter than for example a standard king size box for 20 smoking articles. The sealing region 72, which can also be described as the point on the inner package where the sealing area of the resealable label makes contact can be described by the height 71 as seen in FIG. 5. The height 71 of the sealing region 72 can be not greater than about 20 mm, or not greater than about 18 mm. In some embodiments, the height of the sealing region 72 can be not less than about 10 mm, or not less than about 12 mm. In such embodiments, the lower edge 73 of the sealing region 72 of the resealable label can be shifted upward to make the sealing area shorter. This affords more room under the lid 24 for the insert when the lid is closed. In such embodiments, the bottom edge of the lid can extend at least 2 mm beyond the sealing region 72. The insert 60 in such an embodiment would not be accessible unless the lid is opened.

Figure 6:
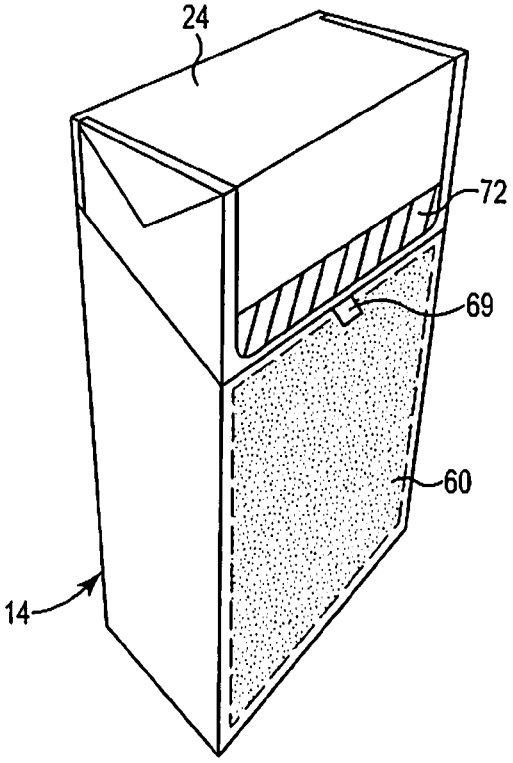
FIG. 6 is a schematic view of an insert with a tear away portion attached thereto.

Referring to FIG. 6, a schematic perspective view of another embodiment of a container that includes an insert with a tab is illustrated. The insert 60 includes a tab 69 that functions as the access region of the insert. The tab 69 is coextensive with the remaining portion of the insert. The tab 69 can be configured to be folded towards the box 14, have about a 90 degrees angle with the box, or otherwise. Preferably, the tab is folded down towards the insert not the lid. The tab 69 can be made of the same material or a different material than the rest of the insert. The tab can have any usable dimensions. In such embodiments, the upper edge of the insert is predominantly above the upper edge of the front wall of the box and the tab extends even farther above the upper edge. The insert 60 in such an embodiment would be accessible whether the lid is open or closed.

The invention claimed is:

1. A container (10) for consumer goods, comprising:

a housing (12) comprising a box (14) and a lid (20) hingedly attached to the box, the box having a front wall (16) and a back wall, the front wall having an inner surface, the lid comprising a front wall (24), wherein the lid has an inner surface (22) and an outer surface (26) and the front wall (16) of the box has an upper edge (21);

an inner package (30) disposed within the housing and at least partially defining an interior volume for housing consumer goods, the inner package (30) having a front wall that has an outer surface, the inner package comprising a first layer (40) and a second layer (50), the first layer comprising a flap (44), the flap attached to the inner surface of the lid and the flap configured to be releasably attached to a sealing region (72) of the second layer to open and close the inner package by opening and closing the lid; and an insert (60) positioned between the inner surface of the front wall of the box and the outer surface of the front wall of the inner package, wherein the insert has an upper edge (35), wherein the insert is positioned entirely below the sealing region and positioned so that the lowest point of the upper edge of the box is lower than the highest point of the upper edge of the insert, and wherein the sealing region and upper edge of the insert are rectilinear and horizontal.

2. The container of claim 1, wherein the insert comprises an access region (62) on the upper edge that allows it to be removed from the container.

3. The container of claim 2, wherein the access region extends from 2 mm to 10 mm away from the upper edge of the insert.

4. The container of claim 1, the front wall of the lid having a length of from 25 mm to 60 mm.

5. The container of claim 1, wherein the housing has an opening line (64) that forms the lid and the box and wherein the opening line has an angle from 30 degrees to 60 degrees as measured from the back wall (18) of the box.

6. The container of claim 1, wherein the sealing region has a height from 10 mm to 20 mm.

7. The container of claim 6, wherein the lid extends at least 2 mm beyond the sealing region.

8. The container of claim 7, wherein the insert is removable only when the lid is open.

9. The container of claim 1, wherein the access region of the insert further comprises a tab (69).

10. The container of claim 9, the tab comprising a coextensive portion of the insert that is folded towards the insert.

11. The container of claim 9, wherein the insert is removable when the lid is open or closed.

12. The container of claim 1 further comprising the consumer goods, wherein the consumer goods are housed in the interior volume defined by the inner package.

13. The container of claim 12, wherein the consumer goods are smoking articles.

14. The container of claim 12, wherein the consumer goods are cigarettes.

15. A carton comprising:

at least one container (10) for consumer goods, comprising:

a housing (12) comprising a box (14) and a lid (20) hingedly attached to the box, the box having a front wall (16) and a back wall, the lid comprising a front wall (24), wherein the lid has an inner surface (22) and an outer surface (26) and the front wall (16) of the box has an upper edge (21);

an inner package (30) disposed within the housing and at least partially defining an interior volume for housing consumer goods, the inner package (30) having a front wall that has an outer surface, the inner package comprising a first layer (40) and a second layer (50), the first layer comprising a flap (44), the flap attached to the inner surface of the lid and the flap configured to be releasably attached to a sealing region (72) of the second layer to open and close the inner package by opening and closing the lid; and an insert (60) positioned between the inner surface of the front wall of the box and the outer surface of the front wall of the inner package, wherein the insert has an upper edge (35), wherein the insert is positioned entirely below the sealing region and positioned so that the lowest point of the upper edge of the box is lower than the highest point of the upper edge of the insert, and wherein the sealing region and upper edge of the insert are rectilinear and horizontal.

* * * * *